United States Patent [19]

Ditcher et al.

[11] Patent Number: 4,540,310

[45] Date of Patent: Sep. 10, 1985

[54] MANHOLE RISER AND COOPERATING SLEEVE TO PROVIDE A WATERLOCK FOR MANHOLE STRUCTURES

[75] Inventors: Jack Ditcher, Langhorne; Eric A. Ditcher, Cornwells Heights, both of Pa.

[73] Assignee: A-Lok Products, Inc., Tullytown, Pa.

[21] Appl. No.: 514,584

[22] Filed: Jul. 18, 1983

[51] Int. Cl.[3] ..... E21D 29/14

[52] U.S. Cl. ..... 404/25; 52/20; 277/12; 277/207 A

[58] Field of Search ..... 404/25, 26, 5; 52/19, 52/20, 21; 277/12, 32, 207 A, DIG. 6; 210/163–166

[56] References Cited

U.S. PATENT DOCUMENTS

| | | | |
|---|---|---|---|
| 2,254,668 | 9/1941 | Tomek | 404/26 |
| 3,759,280 | 9/1973 | Swanson | 52/21 |
| 4,188,151 | 2/1980 | Hall | 404/25 |
| 4,248,546 | 2/1981 | Danner | 404/25 |
| 4,305,679 | 12/1981 | Modi | 404/25 |
| 4,337,005 | 6/1982 | Le Baron | 404/26 |
| 4,350,351 | 9/1982 | Martin | 277/207 A |
| 4,368,893 | 1/1983 | Gagas | 404/25 |

FOREIGN PATENT DOCUMENTS

| | | | |
|---|---|---|---|
| 1496899 | 1/1978 | United Kingdom | 52/21 |
| 0735707 | 5/1980 | U.S.S.R. | 52/20 |

*Primary Examiner*—James A. Leppink
*Assistant Examiner*—Hoang C. Dang
*Attorney, Agent, or Firm*—Louis Weinstein

[57] ABSTRACT

A hollow cylindrical-shaped, hat-like sleeve is water-tightly joined with the upper end of the riser section of a manhole structure. The free end of the sleeve is trimmed so that its upper edge fits beneath the shoulder of the frame supporting the manhole cover to prevent subsurface water from entering into the manhole interior through the regions between the manhole cover supporting frame and the top of the riser section, which is usually fitted with adjustment rings to bring the manhole cover frame up to grade. The sleeve is easily cut to any height to accommodate either a greater or lesser number of height adjustment rings. The sleeve flange may be cast into the riser section, or alternatively be placed upon the riser section and water-tightly sealed in place by gaskets. The sleeve flange may be replaced by a gasket-like water stop arranged about the lower end of the sleeve and joined thereto by a suitable waterproof rubber adhesive. The water stop may be cast into or joined to the manhole riser or, alternatively, positioned between the manhole riser and an adjacent adjustment ring.

15 Claims, 8 Drawing Figures

MANHOLE RISER AND COOPERATING SLEEVE TO PROVIDE A WATERLOCK FOR MANHOLE STRUCTURES

FIELD OF THE INVENTION

The present invention relates to apparatus for providing water-tight manhole structures, and more particularly, to a novel combination manhole riser section and plastic sleeve either mounted upon or integral therewith for preventing subsurface water from entering into the interior of a manhole structure by gaining access thereto in the region between the manhole cover support frame and the top of the riser section.

BACKGROUND OF THE INVENTION

Manhole structures are arranged at predetermined intervals along sewage lines, for example, for inspection and cleaning purposes, and for providing an intersection between two branches of a sewer line merging into a third, to name just a few applications.

A manhole structure is typically comprised of a manhole base, an intermediate section and a top riser section. The manhole based is placed beneath grade at a depth dependent upon the depth of the sewer line entering the base, through an opening made water-tight through a cooperating gasket. The intermediate and riser sections are utilized to bring the manhole structure up to grade, and provide a water-free, hollow interior which may be easily entered for repair and/or maintenance. The open top of the manhole structure is sealed with a manhole cover removably supported upon a supporting frame, which either rests directly upon the top of the riser section or rests upon the top surface of a grade adjustment ring which may, for example, be one of a plurality of grade adjustment rings positioned between the top surface of the riser section and the bottom surface of the manhole cover support frame, in order to bring the frame opening supporting the manhole cover up to grade.

In order to prevent subsurface water from entering into the interior of the manhole structure through the region of the engaging surfaces between the manhole cover and the adjustment rings, and/or between the engaging surfaces of adjacent adjustment rings, and/or between the engaging surface of an adjustment ring in the top surface of the riser section, mortar is placed between these engaging surfaces. However, due to irregularities in the engaging surfaces; shrinkage and dynamic loading, natural erosion and deterioration of the mortar due to frost heave, surface water eventually seeps through the above-mentioned regions to enter into the interior of the manhole structure.

It is further desirable to install manhole structures in such a way as to limit on-site activities to a minimum and it is, therefore, desirable, not only to provide water-tight seal in the region between the manhole riser section and the manhole cover support frame, but to be able to accomplish this through the use of a manhole structure, which is of simplified design and is easy to install and does not require additional, complicated manual activity at the installation site.

BRIEF DESCRIPTION OF THE INVENTION

The present invention is characterized by comprising a riser section incorporating an integral plastic sleeve, having a flange cast into the riser section. The height of the sleeve is sufficient to accommodate rather large adjustment gaps between the wall cover supporting frame and the top of the riser section and is preferably formed of a plastic material which, although having excellent ability to withstand erosion and/or deterioration over a long period of time, is easy to cut, in order to position the trimmed cut edge of the free end of the sleeve immediately beneath the shoulder of the manhole cover support frame.

The method for installing the novel apparatus of the present invention is as follows.

The manhole base, intermediate and riser sections are installed into the ground using conventional techniques and such that the aforementioned plastic sleeve, whose flange is cast into the top region of riser section extends upwardly and above the top surface of the riser section and has an outer diameter which is slightly less than the inner diameter at the open upper end of the riser section.

Dependent upon the depth of the top surface of the riser section relative to grade, none, one or more than one grade adjustment ring is positioned upon the top surface of the riser section. If desired, mortar is placed in the regions between the engaging faces of said members.

The distance between the top surface of the riser section and the interior shoulder of the manhole cover supporting frame is determined, and the top portion of the free end of the sleeve is removed by a simple cutting operation, to locate the top edge of the sleeve just beneath the aforesaid shoulder of the manhole cover supporting frame thereby completing the installation operation. Since the sleeve providing the water-tight capability is cast into the riser section of the factory, no positioning and/or securement of the sleeve to the riser section is necessary, thus greatly simplifying installation.

Although subsurface water may seep into the region between the manhole cover supporting frame and/or the adjusting rings and/or the top surface of the riser section, the sleeve totally prevents water from entering into the interior of the manhole structure.

As an alternative arrangement, the sleeve may be separate from the riser section. The flange portion is positioned between upper and lower rubber or rubber-like gaskets that are firmly squeezed between the riser section and grade ring or manhole cover support frame positioned thereon to form a water-tight seal. A second rubber gasket arranged to encircle the outer perimeter of the flange provides an additional water-tight seal.

As another alternative arrangement, the flange portion of the sleeve may be eliminated and replaced by a rubber or elastomeric water stop attached to the lower end of the plastic sleeve with a suitable waterproof rubber adhesive. The water stop, which defines a manual or gasket-like member, is joined to or embedded within a groove provided just beneath the top end of the opening in the manhole riser.

The top edge of the sleeve is trimmed in the same manner as was previously described, so that it is positioned just beneath the interior shoulder of the manhole cover supporting frame.

OBJECTS OF THE INVENTION AND BRIEF DESCRIPTION OF THE DRAWINGS

It is, therefore, one object of the present invention to provide a novel combination riser section and sleeve, either mounted upon or integrally cast therewith, for use in manhole structures to prevent subsurface water in the region between the manhole cover support frame and the riser section from entering into the interior of the manhole structure.

Still another object of the present invention is to provide a water-tight sleeve of the character described, wherein the sleeve comprises a cylindrical sleeve portion having a flange at its lower end which either water-tightly engages, or is integrally cast into, the riser section.

Still another object of the present invention is to provide a combination riser section and sleeve of the character described, wherein the sleeve is formed of a plastic material capable of withstanding erosion and/or deterioration due to the exposure to sewage and/or subsurface water and the like, and yet which is easily trimmed with a simple cutting tool, such as a knife, to facilitate simple and rapid adjustment of the height of the sleeve relative to the top of the riser section will provide the desired water-tight protection.

The above, as well as other objects of the present invention will become apparent when reading the accompanying description and drawing in which.

DETAILED DESCRIPTION OF THE INVENTION

Figure 1:
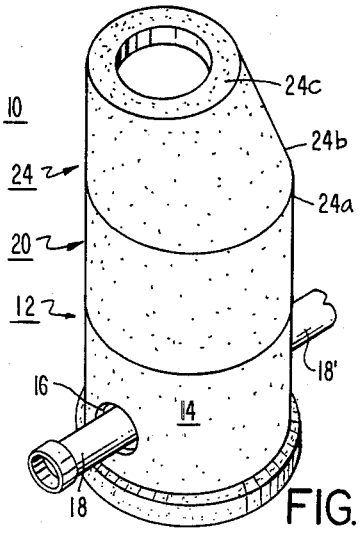
FIG. 1 shows a perspective view of a manhole structure, which may utilize the sleeve of the present invention to greater advantage.

FIG. 1 shows a conventional manhole structure 10 embodying the principles of the present invention and comprised of a base 12 having openings 16 in its cylindrical side wall 14 for receiving a pipe, such as pipe 18, which may, for example, be a sewer pipe. Base 12 is located at a predetermined distance below surface 22 (FIG. 2) to assure that the end of pipe 18 entering opening 16 is at the proper depth below grade.

An intermediate section 20 is arranged upon base 14, and a gasket is typically utilized between the mating surfaces via the water-tight seal. Riser section 24 is arranged upon intermediate section 20, and a gasket is typically utilized between the mating surfaces to provide a water-tight seal. The riser section has a lower portion 24*a* of greater diameter to properly mate with the upper surface of intermediate section 20. The upper section 24*b* of the riser 24 is tapered forming an upper end 24*c*, which properly mates with the manhole cover support frame or grade rings, as the case may be.

Figure 2:
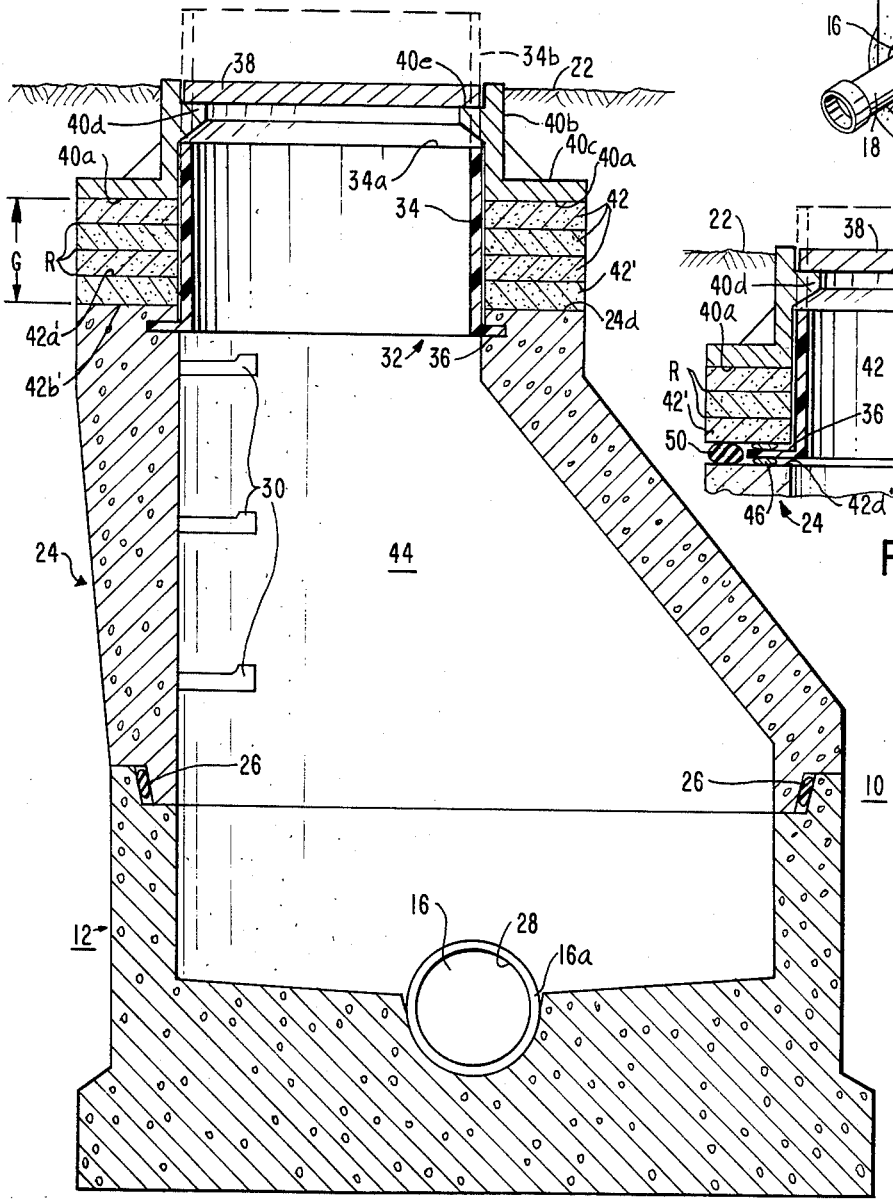
FIG. 2 shows a sectional view of a manhole structure embodying the sleeve of the present invention.

FIG. 2 shows a manhole structure 10, which is modified relative to the manhole structure 10 of FIG. 1, in that intermediate section 20 has been omitted for purposes of simplicity. FIG. 2 shows the mating surfaces provided at the top end of base 14 and the bottom end of riser section portion 24*a* to assure that the riser section is properly seated upon base 14. A continuous annular gasket 26 is arranged between the diagonally-aligned mating surfaces and is under compression. Riser section 24 is seated on base 14. It should be understood that the intermediate section 20 mates with the base 14 and riser section 24 in a similar manner. Depending upon the required location of base 14, intermediate section 20 may or may not be needed.

Opening 16, which receives a pipe, is provided with an annular resilient gasket 28, which provides a water-tight seal between the exterior surface of the pipe 18 and the wall 16*a*, defining the opening 16 in manhole base 14.

The U-shaped steps 30 are cast into the straight wall of riser section 24 to facilitate the entry and egress of an operator in manhole structure 10.

Figure 3:
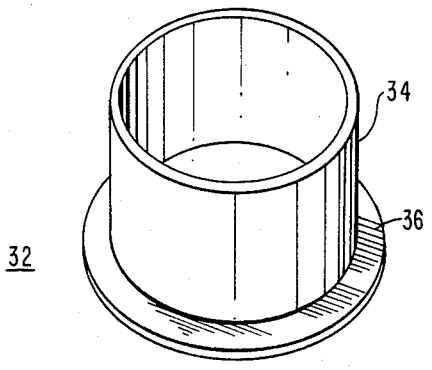
FIG. 3 shows a perspective view of the sleeve employed in the embodiments of FIGS. 2 and 4.

The plastic sleeve 32, shown also in FIG. 3, is utilized to provide the water-tight seal, is comprised of an elongated cylindrical sleeve portion 34, having an outwardly extending integral flange 36 at its bottom end. In the embodiment shown in FIG. 2, flange 36 is integrally cast into the upper portion 24*c* of riser section 24.

In order to locate the manhole cover 38 at grade, i.e., substantially co-planar with road or ground surface 22, it is typically necessary to build up the gap space G between the top surface 24*d* of riser section 24 and the bottom surface 40*a* of manhole support port frame 40, with one or a plurality of grade adjustment rings 42.

Frame 40 is preferably formed of cast iron and has a cylindrical-shaped portion 40*b*. The lower end is joined to an integral outwardly directed flange 40*c*, having bottom supporting surface 40*a*. An inwardly directed flange 40*d* forms supporting shoulder 40*e*, which serves to support manhole cover 38, as shown.

Grade rings 42 are circular-shaped discs of finite thickness and have flat upper and lower mounting surfaces. Noted, for example, bottom-most grade ring 42', which has upper surface 42*a'* and lower surface 42*b'*. Lower surface 42*b'* may engage the supporting surface 24*d* of a riser section 24, or may engage the top surface of an adjacent grade ring 42. The top surface 42*a'* of grade rang 42' may engage the bottom surface of the next adjacent grade ring thereabove, or may engage the bottom surface 40*a* of support frame 40. Mortar is preferably arranged in the regions R between aforesaid engaging surfaces.

Installation of the structure 10 is performed as follows. The base 12, intermediate 20, and riser 24 sections are installed using conventional techniques, the intermediate section 20 being either utilized or omitted dependent upon the depth of the base section 14 relative to grade. The riser section 24 incorporates water-tight sleeve 32. Mortar is placed upon the lower surface of each engaging region R and the number of grade rings 42 (and 42') required to bring the manhole cover 38 substantially into co-planar alignment with grade 22, are mounted one atop the other. The top portion of sleeve 34 is trimmed by a conventional cutting tool such as, for example, a knife, to bring the top-most edge just beneath the diagonally aligned surface of shoulder 40*d*, as shown in FIG. 2. The removed portion 34*b* is shown in dotted fashion. The sleeve 34 is thick enough to withstand deterioration and yet thin enough to facilitate the trimming operation. The thickness of sleeve 34 is preferably in the range from 0.040 to 0.100 inches.

Even assuming that any subsurface water is capable of penetrating through the regions R in the gap G between manhole cover frame 40 and the top surface 24*d* of riser section 24, sleeve 32 completely prevents subsurface water reaching the exterior surface of sleeve 34 from entering into the interior 44 of manhole structure 10. It can be seen that the installation is quite simple and straightforward, the only additional step required at the jobsite being the trimming of the top portion 34*b* of sleeve 34, which is a simple and straightforward operation requiring no special tools.

Figure 4:
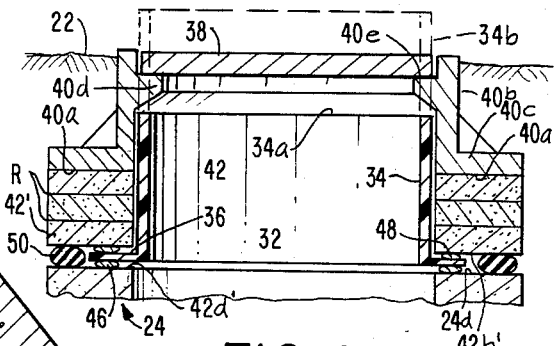
FIG. 4 shows another alternative manhole installation employing the sleeve of FIG. 3.

FIG. 4 shows an alternative embodiment of the present invention, in which the sleeve 32, as an alternative to being integrally cast with riser section 24, is arranged so that its flange 36 is positioned between the top surface 24*d* of riser section 24 and the under surface 42*b*′ of grade ring 42′. The water-tight sleeve 32 is installed as follows:

The installation of the base 12, intermediate 20, and riser 24 sections is accomplished in the same manner as was previously described. An elongated rope-like member 46, preferably formed of uncured butyl rubber, is laid upon the top surface 24*d* of riser section 24 to form a first ring 36. Flange 36 is placed upon ring 46. A second ring 48 formed of the same rope-like material, is formed on the top surface of flange 36. A third ring 50 of a cross-sectional diameter, which is at least twice as great as the rope-like rings 46 and 48, is arranged upon the top surface 24*d* of riser section 24, so as to encircle the flange 36. Alternatively, two rings of the diameter of ring 48 may be utilized for member 50. Grade ring 42′ is placed upon rings 48 and 50. The weight of grade ring 42′ causes ropes 46, 48 and 50 to undergo compression and flattening to provide a good water-tight seal. The uncured butyl rubber material is also self-adhesive and adheres to the upper and lower surfaces of flange 36, surface 42*b*′ of grade ring 42′ and surface 24*d* of riser section 24, as well as undergoing compression, the adhesive and compressive properties of the rope members 46, 48 and 50, thereby providing an excellent water-tight seal between ring 42 and riser section 24. The uncured butyl rubber does not degrade or deteriorate, even after long exposure to subsurface water.

The top portion 34*b* of the sleeve cylindrical portion 34 is trimmed in the same manner as was previously described, so that its top edge 34*a* is positioned just beneath shoulder 40*d*. The installation of the alternative embodiment shown in FIG. 4, differs from that of the embodiment shown in FIG. 2, only in the added steps of arranging the rope-like members and the water-tight sleeve 32 upon surface 24*d* of riser section 24. These operations are quite simple and may be easily performed by unskilled personnel.

Figure 5:
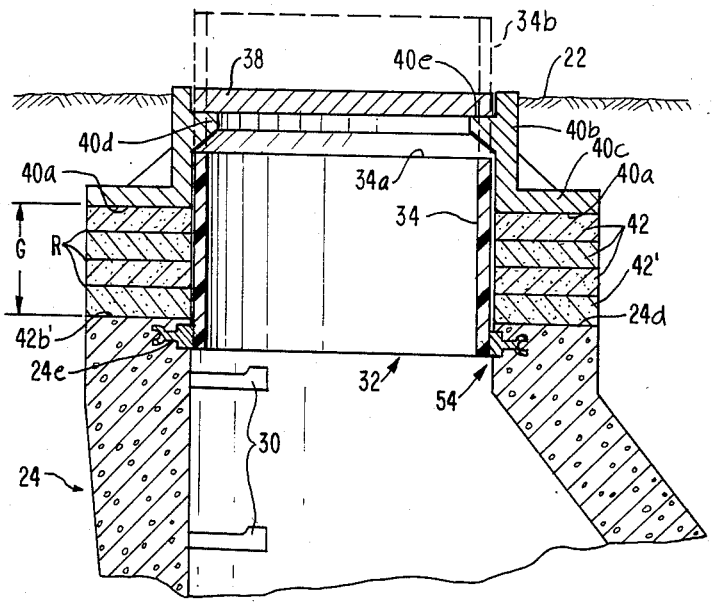
FIG. 5 shows a sectional view of a manhole structure incorporating another alternative embodiment for the waterlock sleeve of the present invention.
Figure 6:
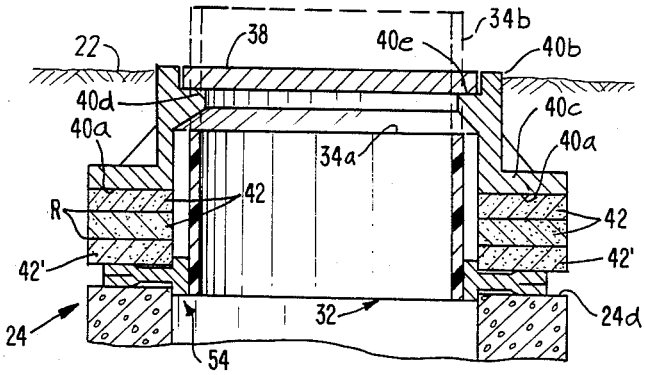
FIG. 6 shows a detailed view of the sleeve shown in FIG. 5.

The water lock sleeve embodiment of FIGS. 5 and 6 differs from the embodiments shown in FIGS. 1 through 4, in that the flange 36 of sleeve 34 is omitted and is replaced by a rubber or elastomeric water stop 54 comprised of an extruded rubber or elastomeric member encircling the outer surface of the lower end of sleeve 34, and having a substantially flat surface portion engaging the surface of sleeve 34, which surface portion is coated with a waterproof rubber adhesive to join the water stop 54 to the lower end of sleeve 34. The water stop 54 extends outwardly from the surface of sleeve 34 and may be cast into riser 24 or embedded within a groove 24*e* provided just below the top end of the opening in manhole riser 24 to form a watertight seal. Alternatively, as shown in FIG. 6, the free end of the water stop may extend between the top surface 24*d* of riser 24, and the bottom surface of the first height adjustment ring 42′. The resilient nature of the material causes it to be compressed and hence provides an excellent water-tight seal between riser 24 and ring 42′, as well as providing a watertight seal between sleeve 34 and manhole riser 24, to prevent any water which may seep into the spaces between the top surface of riser 24 and height adjusting ring 42′, or between any of the rings 42 or between the topmost ring 42 and the manhole cover support 40.

Figure 7:
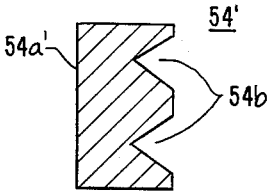
FIGS. 7 and 8 show detailed sectional views of the waterstop employed in the embodiment of FIGS. 5 and 6.
Figure 8:
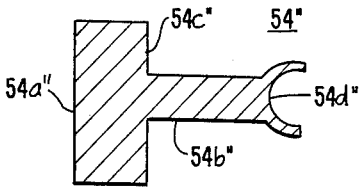

FIGS. 7 and 8 show suitable cross-sectional configuration of the water stop, FIG. 7 showing a water stop configuration 54′ having a flat surface 54*a*′ for engaging and being adhesively secured to the lower end of sleeve 34 and having elongated grooves 54*b*′ formed in the outer surface of the extruded member 54′. The grooves 54*b*′ may be fitted into grooves of a conforming shape, cut or otherwise formed within the interior surface of riser 24 or, if desired, the extruded member 54′ may be cast into riser 54. Alternatively, the extruded member 54′ may be placed between the top surface 24*d* of manhole riser 24 and the bottom surface of height adjustment ring 42′.

FIG. 8 shows an alternative cross-sectional configuration for an extruded member 54″ having a flat surface 54*a*″ for being adhesively joined to the lower end of sleeve 34 and having an outwardly extending web 54*b*″ integrally joined to thick body portion 54*c*″ and having its free end provided with a substantially C-shaped portion 54*d*″. Web 54*b*″ and free end 54*d*″ may be cast into the manhole riser 24 at the upper end thereof and within the opening provided therein, or may be arranged within a groove cut within the interior surface of manhole riser 24 or, alternatively, may be positioned between the top surface 24*d* of manhole riser 24 and the bottom surface of height adjustment ring 42′.

All of the embodiments of the invention are unaffected by dynamic loads and deterioration of the mortar and/or the grade rings, thus assuring the provision of an excellent water-tight seal capable of being achieved in prior art structures.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. Apparatus for providing a water-tight seal in the region above the riser section of a manhole structure comprising:

plastic sleeve means having an integral flange centrally located upon the top of said riser section, said flange extending over at least a portion of the top surface of the riser section, the outer diameter of the riser section being greater than the outer diameter of the flange;

a manhole cover support frame with an integral annular upper flange for supporting a manhole cover and an integral lower supporting flange;

at least one grade ring arranged between the lower supporting flange of said manhole cover support frame and the top surface of said riser section and extending over the top surface of said integral flange of said sleeve means;

said support frame lower supporting flange being arranged upon said grade ring;

resilient compressible gasket means arranged between said support frame lower supporting flange and the top surface of said riser section, for providing a water-tight seal therebetween;

said sleeve means extending upwardly from said integral flange to extend above said riser section, through said grade ring and into said manhole cover support frame and above the lower supporting flange and adjacent to and below said upper flange to prevent subsurface water, which may seep into the region between said frame and riser section, from entering into the interior of said manhole structure;

the sleeve means having a diameter sufficient to permit ingress into and egress from the manhole structure by a person without moving the sleeve means;

said sleeve means being formed of a plastic material.

2. The apparatus of claim 1, wherein said plastic material comprises polyvinylchloride.

3. The apparatus of claim 1, wherein the thickness of said sleeve means is in the range of 0.040 to 0.100 inches.

4. The apparatus of claim 1, wherein said sleeve means comprises a hollow cylindrical portion and said flange has an inner end integrally joined to one end of said hollow cylindrical portion and extending radially outward therefrom.

5. The apparatus of claim 1, wherein a plurality of grade rings are provided between said riser section and said manhole cover supporting frame, said flange being positioned between the top surface of said riser section and the bottom surface of the grade ring positioned thereupon, said sleeve means extending through all of said grade rings.

6. The apparatus of claim 1, wherein said gasket means comprises first and second rope-like members formed of a resilient compressible rubber-like material positioned above and below said flange in a ring-shaped fashion to provide a continuous water-tight seal.

7. The apparatus of claim 6 further comprising a third elongated rope-like member formed of a resilient compressible rubber or rubber-like material positioned upon the top surface of said riser section and encircling the flange of said sleeve means to provide an additional water-tight seal surrounding said flange.

8. The apparatus of claim 7, wherein said third rope-like member encircling said flange has a diameter at least twice that of the rope-like members arranged above and below said flange.

9. The apparatus of claim 8, wherein the third rope-like member preferably comprises a pair of rope-like members arranged one upon the other and each having a diameter substantially equal to the diameter of the first and second rope-like members arranged respectively above and below the flange of said sleeve.

10. The apparatus of claim 1 wherein said flange means comprises a resilient gasket-like water stop encircling the lower end of said sleeve means and being adhesively joined thereto.

11. The apparatus of claim 1 wherein said flange is a gasket-like water stop formed of a resilient compressible material, the inner periphery of said flange being adhesively secured to said sleeve means, said flange being arranged between said riser section and a grade ring.

12. Apparatus for providing a water-tight seal in the region above the top opening of a cylindrical riser section of a manhole structure comprising a water-tight plastic sleeve means having a lower portion thereof integrally cast into a portion of said riser section preferably during the casting of said riser section;

a manhole cover support member having a lower supporting flange adapted to be positioned upon the top surface of the riser section and having an upper flange for supporting a manhole cover;

said sleeve means extending upwardly from the top portion of said riser section and being formed of a material capable of being cut with a simple cutting tool, to position the top edge of said sleeve means into the central opening of said manhole cover support frame and above the supporting flange of said support frame and just below the upper flange to prevent subsurface water which may enter into the region between said manhole cover support frame and the top of said riser section from entering into the interior region of the manhole structure;

said sleeve means being comprised of a hollow cylindrical portion having an outwardly directed flange integral with the bottom portion thereof, said flange being cast into the portion of said riser section;

said sleeve means having a diameter sufficient to allow ingress into and egress from the manhole structure by a person without removing the sleeve means;

grade rings being arranged between the top surface of riser section and the supporting lower flange of the manhole cover supporting frame to position the manhole cover so that it is substantially co-planar with grade;

said cylindrical portion of the sleeve means being longer than the height of the total number of grade rings arranged upon said riser section.

13. The apparatus of claim 12, wherein said sleeve means is trimmed to extend through the number of grade rings arranged between said riser section and said manhole cover support frame and which are necessary to locate the manhole cover substantially at grade.

14. The apparatus of claim 12, wherein said sleeve means is formed of polyvinylchloride having a thickness sufficient to withstand the deterioration thereof due to exposure to subsurface water while at the same time being sufficiently thin to facilitate cutting by a simple cutting tool.

15. The apparatus of claim 12 wherein said flange is a gasket-like water stop formed of a resilient compressible material, the inner periphery of said flange being adhesively secured to said sleeve means and the outer portion thereof being the portion which is cast into the riser section.

* * * * *